US005506469A

United States Patent [19]

Vink et al.

[11] Patent Number: 5,506,469

[45] Date of Patent: Apr. 9, 1996

[54] DISPLAY TUBE WITH DEFLECTION UNIT COMPRISING FIELD DEFLECTION COILS OF THE SEMI-SADDLE TYPE

[75] Inventors: Nicolaas G. Vink; Johannes Penninga; Johannes A.P. De Volder, all of Eindhoven, Netherlands

[73] Assignee: U.S. Philips Corporation, New York, N.Y.

[21] Appl. No.: 333,117

[22] Filed: Nov. 1, 1994

Related U.S. Application Data

[63] Continuation of Ser. No. 966,798, Oct. 27, 1992, abandoned.

[30] Foreign Application Priority Data

Nov. 1, 1991 [NL] Netherlands ..... 91202847

[51] Int. Cl.[6] ..... H01J 29/70; H01F 5/00

[52] U.S. Cl. ..... 313/440; 313/426; 335/213

[58] Field of Search ..... 313/440, 426, 313/427, 428; 335/213

[56] References Cited

U.S. PATENT DOCUMENTS

| | | | |
|---|---|---|---|
| 4,464,643 | 8/1984 | Meershoek | 313/428 |
| 4,874,983 | 10/1989 | Sluyterman | 313/440 |
| 4,937,931 | 7/1990 | Jacobs et al. | 335/213 |
| 4,962,333 | 10/1990 | Sluyterman | 313/440 |
| 5,001,390 | 3/1991 | Vink et al. | 313/440 |
| 5,013,964 | 5/1991 | Vink et al. | 313/440 |
| 5,077,533 | 12/1991 | Klingelhofer | 313/426 |
| 5,121,028 | 6/1992 | Milili | 313/440 |

*Primary Examiner*—Sandra L. O'Shea
*Assistant Examiner*—Vip Patel
*Attorney, Agent, or Firm*—Robert J. Kraus

[57] ABSTRACT

Display tube comprising an electromagnetic deflection unit with field deflection coils of the saddle type having a lying gun-sided lobe which is provided with a plurality of sub-assemblies each comprising two longitudinal conductor groups which are connected at their gun side by means of a connection group of conductors lying flush with the longitudinal conductor groups, the first sub-assembly being arranged within the second, the second within the third, and so forth. Field coma errors, field astigmatism (isotropic and anisotropic) and north-south raster errors can be simultaneously minimized by means of such field deflection coils.

14 Claims, 3 Drawing Sheets

DISPLAY TUBE WITH DEFLECTION UNIT COMPRISING FIELD DEFLECTION COILS OF THE SEMI-SADDLE TYPE

This is a continuation of prior application Ser. No. 07/966,798, filed on Oct. 27, 1992, now abandoned.

BACKGROUND OF THE INVENTION

The invention relates to a display tube comprising an electron gun system, a longitudinal axis, a display screen and an electromagnetic deflection unit, which unit comprises a line deflection coil system and a field deflection coil system having two field deflection coils lying opposite each other, with respect to the longitudinal axis, each field deflection coil having a lying gun-sided lobe and with respect thereto upstanding, screen-sided lob with a window in between.

In monochrome display tubes the electron gun system is adapted to generate one electron beam, whereas in, for example, colour display tubes of the in-line type the electron gun system is adapted to generate three coplanar electron beams which converge on the display screen.

The electromagnetic deflection unit for deflecting electron beams is used for deflecting the electron beams in two orthogonal directions from their normal undetected straight path so that the beams impinge upon selected pixels of the display screen so as to provide visual indications on this screen. The electron beams can be moved up or down or from left to right across the (vertically arranged) display screen by suitably varying the magnetic deflection fields. A visual presentation of information or a picture can be formed on the display screen by simultaneously varying the intensity of the beams. The deflection unit, which is secured to the neck portion of the display tube, comprises two systems of deflection coils for deflecting the electron beams in two directions which are transverse to each other; a line deflection coil system to which a line frequency signal is applied during operation and a field deflection coil system to which a field frequency signal is applied during operation. Each system comprises two coils arranged with respect to the tube axis at positions facing each other.

An annular core of magnetizable material surrounds the systems of deflection coils in the conventional manner for concentrating the deflection fields and for increasing the flux density in the deflection area.

To satisfy given requirements of picture quality, magnetic field components of a higher order are often to be added to the (dynamic) magnetic dipole deflection fields. For example, the increasingly stringent requirements of convergence in three-in-line colour television systems necessitate a strong positive magnetic six-pole component at the gun side of the vertical deflection field in addition to a strong negative magnetic six-pole component in the central area of the vertical deflection field. The strong positive six-pole component is necessary for field coma correction. (The effect of a positive six-pole component on the dipole deflection field is a pincushion-shaped field variation.) For a self-converging in-line colour system with green as the central beam and red and blue as the outer beams the field coma is understood to mean a vertical offset of the red and blue beams with respect to the green one. If no coma correction measures are taken, red and blue will be deflected to a stronger extent than green. In the case of a pincushion-shaped deflection field at the gun side red and blue have a weaker deflection field than green. Consequently, red and blue will be deflected to a lesser extent.

Roughly speaking, a pincushion-shaped field is generated in the deflection area when the two coils of a system of deflection coils have broad window apertures, whereas a barrel-shaped field is generated when they have small window apertures. The window of a coil is defined by the internal area which is bounded by the two lateral winding packets at both sides of the tube and the transversal connection packets connecting the lateral winding packets to each other. For a self-converging system particularly the vertical deflection field in the central area must be barrel-shaped (the separate field deflection coils must thus have a small window aperture at that area), and pincushion-shaped at the gun side (i.e. a large window aperture), while it must be homogeneous, more pincushion-shaped or less pincushion-shaped at the screen side, dependent on the quantity of admissible east-west raster distortion. Similar field shapes are also important for monochrome systems of display tubes and deflection units which must have a high resolving power.

Until now it has been found impossible to manufacture deflection coils having a window aperture which varies as much as is desired for said applications, while using the conventional winding methods. However, there are different compromise solutions to alleviate the problem. For example, it is common practice to correct coma by means of plates of a soft-magnetic metallic material arranged at the gun side in the vertical deflection field, which plates enhance the pincushion shape of the vertical deflection field in situ. The use of metal plates in the deflection field is, however, undesired if the display tube deflection unit is to be operated at higher frequencies (EVTV, HDTV). In fact, the energy generated by eddy currents in the metal plates cannot be dissipated in a simple manner so that the temperature of the deflection coil(s) may become inadmissibly high.

SUMMARY OF THE INVENTION

It is an object of the invention to provide a possibility of realising the necessary vertical field modulations without using soft-magnetic metal plates and without having to vary the window aperture to an extreme extent.

According to the invention a display tube of the type described in the opening paragraph is therefore characterized in that the gun-sided lobe of each field deflection coil has, in addition to a connection group of conductors bounding the window at the gun side, at least a first and a second sub-assembly, each sub-assembly comprising two longitudinal conductor groups arranged at opposite sides of the tube, which groups are connected at their gun side by a connection group of conductors lying flush with the longitudinal conductor groups, the first sub-assembly being arranged within the second and, if there are more than two sub-assemblies, the second sub-assembly being arranged within the third, and so forth.

The invention is based on the recognition that it should be possible to adjust pre-deflection and six-pole strength independently of each other so as to be able to realise the variations (required for, for example, self-convergence) in the distribution of the vertical deflection field ("vertical deflection field modulations") in the z direction, and that a coil of the semi-saddle type having a plurality of successively arranged sub-assemblies each having a (transversely) extending connection group of conductors provides this possibility in an accurate way. In such coils the use of soft-magnetic metal plates and/or considerably varying window apertures is not necessary.

Deflection coils of the semi-saddle type are self-supporting coils comprising a plurality of conductors which are wound in such a way that they constitute first and second lateral groups which are interconnected by an upstanding (arcuate) front lobe and a lying rear lobe. The rear (gun-sided) lobe is flush with the lateral groups, so that it is parallel to the envelope of the tube.

If the connection group of the first sub-assembly extends along a substantially straight path around the neck of the tube, it is achieved that the vertical dipole field at the gun side has a steeper variation than in conventional field deflection coils. Raster errors and anisotropic astigmatism can be favourably influenced by this way of dipole field modulation, while maintaining, or even strengthening the positive six-pole component required for coma correction.

If the connection group of the second sub-assembly also extends along a substantially straight path around the neck of the tube, it is achieved that the shape of the dipole and the six-pole as f(z) can be set very accurately. Variables are the number of conductors in the longitudinal and connection groups and the axial position of the connection groups. Convergence errors (astigmatism and coma) and north-south raster errors can then be considerably minimized at the same time.

A special advantage is achieved if the connection group of the sub-assembly which is furthest remote from the display screen has a central portion which is located closer to the display screen than the portions adjacent thereto. As it were, two loop-shaped segments are thus formed at the gun-sided end of the relevant sub-assembly, so that a relatively stronger positive six-pole component is generated upon energization. Now it is even possible to simultaneously minimize field coma, field astigmatism, mis-convergence in the corners and north-south raster geometry.

BRIEF DESCRIPTION OF THE DRAWING

These and other aspects of the invention will be described in greater detail with reference to the drawing.

DESCRIPTION OF THE PREFERRED EMBODIMENTS

Figure 1:
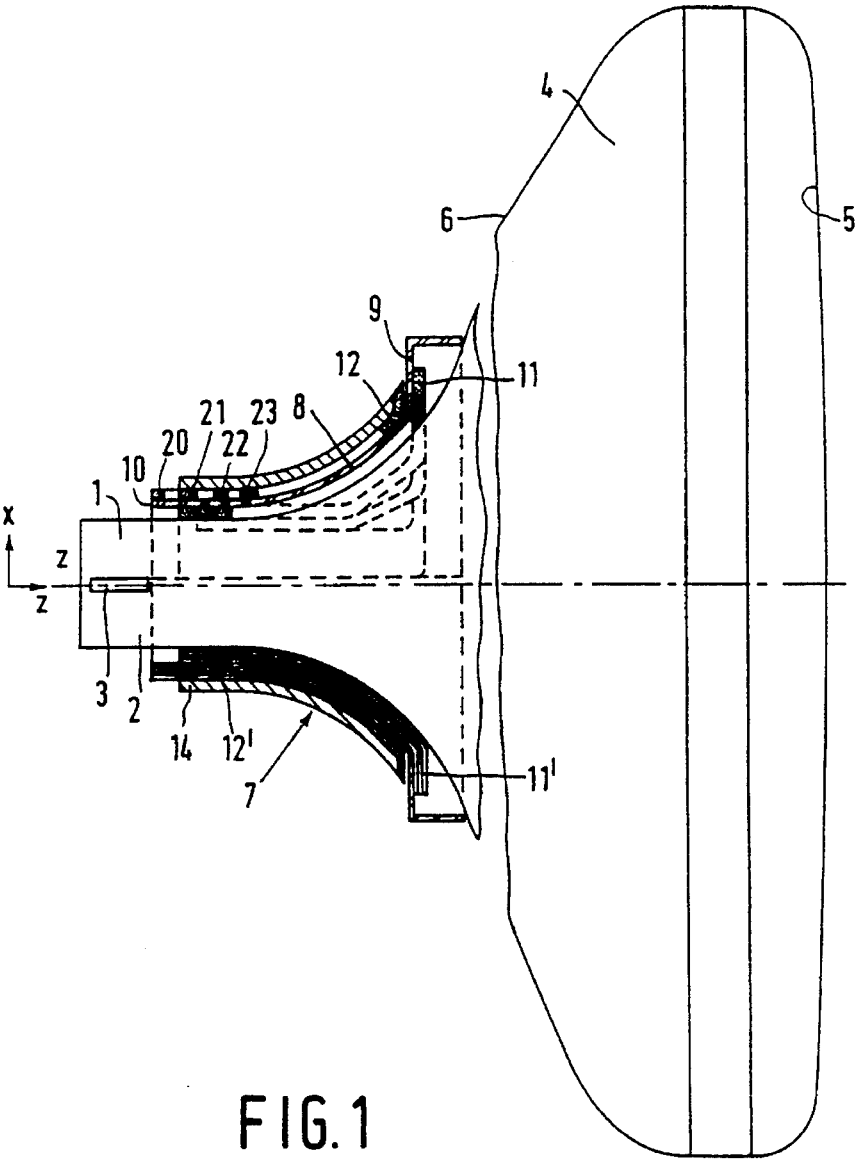
FIG. 1 is a diagrammatic cross-section (through the y-z plane) of a cathode ray tube with a deflection unit mounted on said tube.

FIG. 1 is a cross-section of an embodiment of a display tube 1 having an envelope 6 which extends from a narrow neck portion 2, in which an electron gun system 3 is mounted, to a wide funnel-shaped portion 4 which is provided with a display screen 5. An electromagnetic deflection unit 7 is mounted on the tube at the interface between the narrow and the wide portion. This deflection unit 7 has a support 8 of insulating material, with a front end 9 and a rear end 10. Between these ends 9 and 10 a system of deflection coils 11, 11' for generating a (line) deflection field for deflecting electron beams produced by the electron gun system 3 in the horizontal direction is present at the inner side of the support 8, and a system of coils 12, 12' for generating a (field) deflection field for deflecting electron beams produced by the electron gun system 3 in the vertical direction is present at the outer side of the support 8. The deflection coil systems 11, 11' and 12, 12' are surrounded by an annular core 14 of magnetizable material. Like the coils 11, 11' of the line deflection coil system, the separate coils 12, 12' of the field deflection coil system are of the saddle type having a lying gun-sided lobe (= semi-saddle type).

Figure 2:
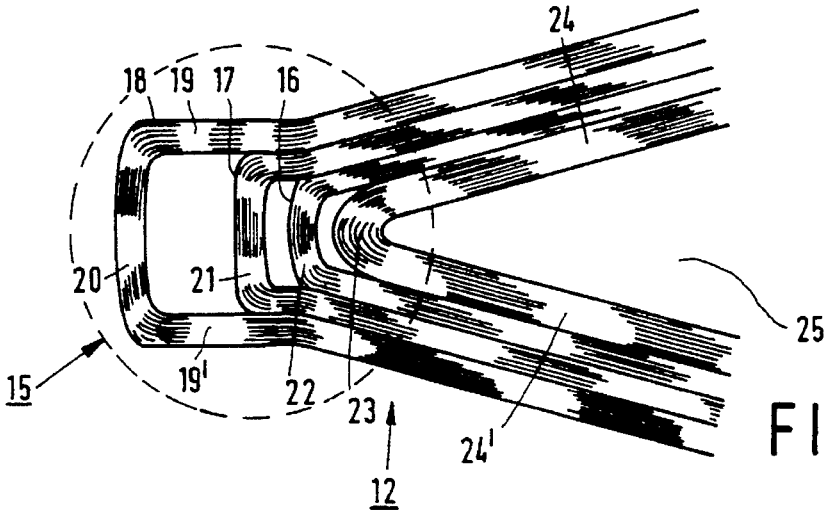
FIG. 2 is a plan view of the gun-sided portion of a field deflection coil which is characteristic of the invention.

FIG. 2 is a plan view of the gun-sided end of the field deflection coil 12 of the construction shown in FIG. 1. The Figure shows that the lying lobe 15 situated within the broken-line circle has a connection group 23 bounding window 25 at the gun side, and three sub-assemblies 16, 17 and 18 each comprising two longitudinal conductor groups 19, 19', . . . etc. arranged at opposite sides of the tube, and a connection group 22, 21 and 20, respectively, lying flush with the longitudinal conductor groups. Sub-assembly 16 is arranged within sub-assembly 17 and sub-assembly 17 is arranged within sub-assembly 18. As it were, the coil 12 has a number of "handles". A handle is a sub-assembly having two longitudinal conductor groups which are arranged parallel to the tube envelope and one connection group lying in the curved plane of the longitudinal conductor groups at a predetermined axial position (z position). The handles form a number of sub-coils with which substantially any field design can be realised at the gun side. More particularly this means that one of the most serious coil problems, viz. the trilemma problem can be effectively solved Coy a special distribution of the wires of the field deflection coil at the gun-sided end).

Figure 3:
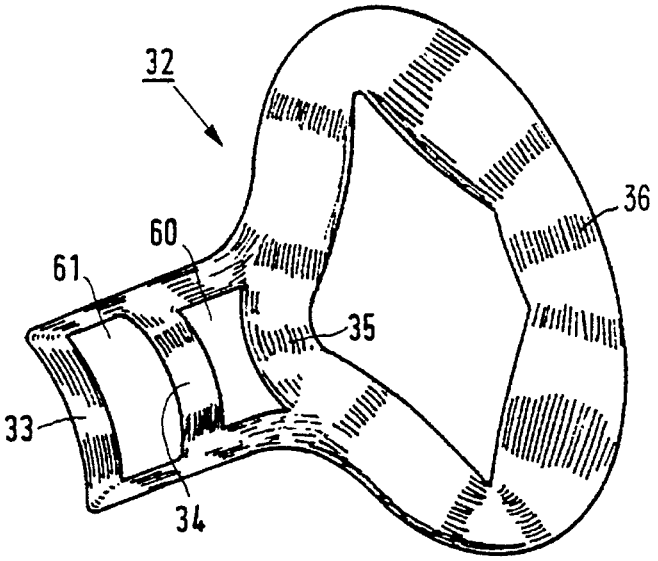
FIGS. 3, 4 and 5 are perspective elevational views of a further embodiment of one coil of a field deflection coil system for a display tube according to the invention.

FIG. 3 is a perspective elevational view of a (field) deflection coil 32 of the semi-saddle type having an upstanding lobe 36 and a lying lobe 35 having two sub-assemblies with respective connection groups 33 and 34 ("double handle") extended at the gun-sided (narrow) end predetermined axial positions.

Figure 4:
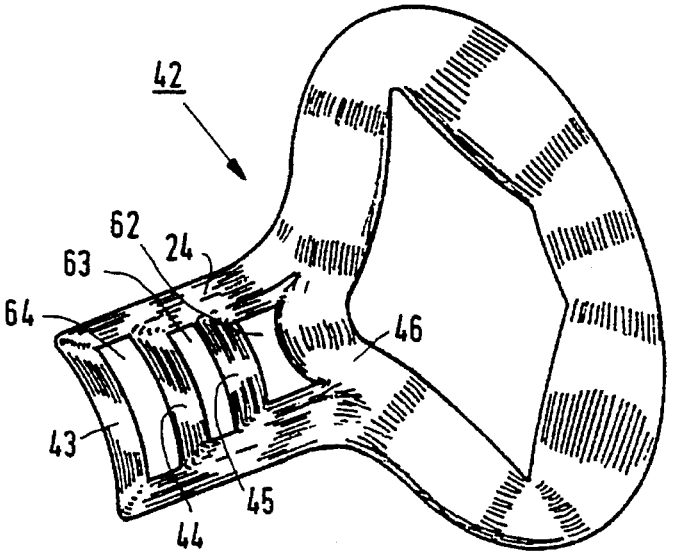

FIG. 4 is a perspective elevational view of a (field) deflection coil 42 of the semi-saddle type having three sub-assemblies with respective connection groups 43, 44 and 45 (triple handle) extending at the gun-sided (narrow) end at predetermined axial positions.

The following phenomena can be influenced by such handle constructions: self-convergence, field astigmatism, field coma, north-south raster and, to a lesser extent, anisotropic convergence effects (crossing in the corners).

Self-Convergence

In certain cases self-convergence can be realised by shifting the field deflection point with respect to the line deflection point. The location of the field deflection point can be accurately set by "shifting" the handles during the design stage.

Field Astigmatism

The field astigmatism is controlled by the extent of predeflection in the area proximate to the narrow end of the window (25; FIG. 2) and the wire distribution in situ. Consequently, the dipole contributions of the handles in that area can influence the predeflection. A second parameter for correcting the field astigmatism is the Z position and the width of the narrow end of the window 25.

Field Coma

Figure 5:
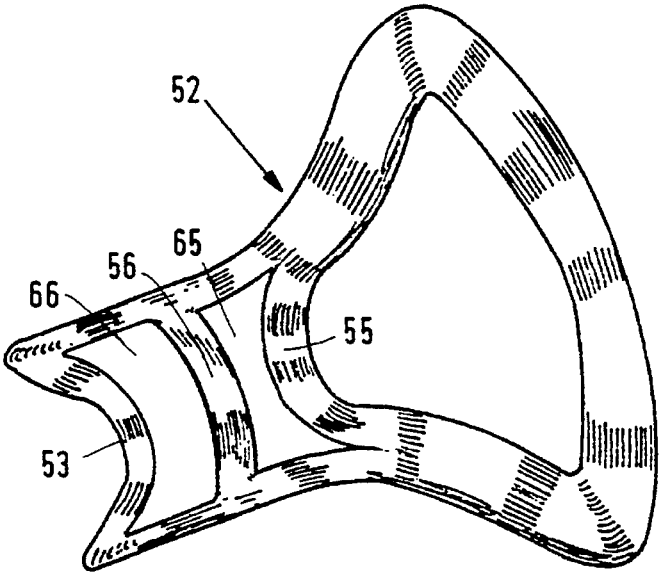
Figure 7:
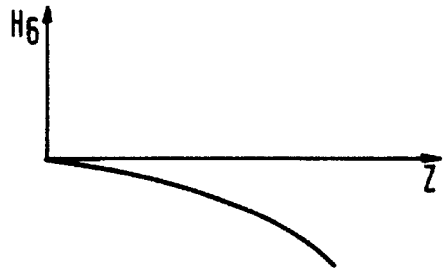
FIG.7 PRIOR ART
Figure 9:
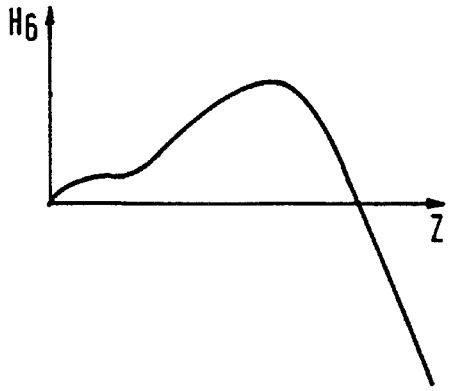

The value of the field coma error is controlled by adjusting the six-pole strength. This may be realised in different manners. Since the fields of the field deflection coil have a low frequency (50–100 Hz), it is possible to exert a force on the beams already above the gun. By providing a central portion of the end-handle with an indentation (53; FIG. 5), such that the central portion is closer to the display screen, two extra current loops (coils) are formed, as it were, at the gun side of deflection coil 52 so that the positive six-pole component is strengthened with respect to the dipole component. Thus, the dipole/six-pole ratio can be adjusted, with which the coma errors can be minimized. It is sometimes possible to approach the effect of the indentation by using two intermediate handles (FIG. 4) instead of one (FIG. 5). This also provides the possibility of generating a strong six-pole, without too much dipole. By forming the first sub-assembly 56 close, or even tangent to the connection group which bounds the window at the gun side (55, FIG. 5), a double effect can be achieved viz. a portion of the conductors is arranged at a larger angle and the terminating conductors, which were initially the last conductors of the connection group 55, extend along a substantially straight path around the neck of the tube. Due to the two actions the six-pole becomes more positive at a substantially equal dipole strength. For example, compare FIG. 7, which shows the six-pole field strength $H_6$ along the z axis at the gun side of a conventional field deflection coil, with FIG. 9 which shows the six-pole field strength $H_6$ along the z axis at the gun side of a field deflection coil of the type shown in FIG. 3.

North-South Raster Distortion

Figure 6:
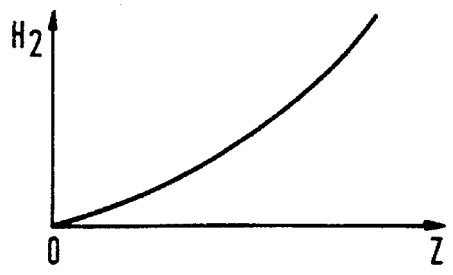
FIG.6 PRIOR ART
FIGS. 6 and 7 are diagrams showing the dipole field strength and the six-pole field strength at the end of a conventional deflection coil.
Figure 8:
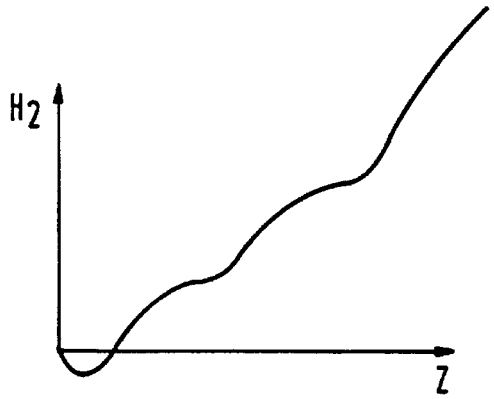
FIGS. 8 and 9 are diagrams showing the dipole field strength and the six-pole field strength at the end of a field deflection coil of the type shown in FIG. 3.

Here the dipole distribution plays a role and it can also be influenced by means of the handle construction. For example, compare FIG. 6, which shows the dipole field strength $H_2$ along the z axis at the gun-sided end of a conventional field deflection coil, with FIG. 8 which shows the dipole field strength $H_2$ along the z axis at the gun-sided end of a deflection coil of the type shown in FIG. 3.

Usable modulation possibilities are particularly obtained by forming two or more discrete handles, i.e. openings are present between the handles, either an elongate and/or (two) triangular openings, so that the handles are separated from each other over at least a part of their circumference. Triangular openings are obtained, for example, when the connection group 56 is tangent to the connection group 55 in the central area (FIG. 5) and/or when the longitudinal conductor groups extend at an angle to each other (60, 61 in FIG. 3; 62, 63, 64 in FIG. 4; 65, 66 in FIG. 5).

The inventive construction of a gun-sided lobe with a fine distribution of connection groups, an important aspect of which is that the current always flows in the same direction in the transversal connection groups of the handles, provides the possibility of influencing the self-convergence condition, the isotropic field coma, the field astigmatism and the north-south raster to a considerable extent and of influencing anisotropic errors and the east-west raster to a small extent.

Of the above-mentioned four errors which can be influenced to a considerable extent there are at least three which can be simultaneously trimmed to a satisfactory extent.

Effects of 0.5 mm can be realised, for example, when displacing 5 wires in a multiple handle. The invention thus provides a strong means in designing the coils because substantial effects can be realised in a simple manner.

We claim:

1. A display tube apparatus comprising a display tube including a longitudinal axis, a display screen, an electron gun system for producing at least one electron beam, and electromagnetic deflection means for producing an electron-beam deflection field, said means including a line deflection coil system and a field deflection coil system, one of said deflection coil systems including first and second saddle-type deflection coils disposed at opposite sides of the display tube, each of said deflection coils including a transversely extending conductor group, at an end of said coil remote from the gun, and:

a. an inner coil sub-assembly including a pair of longitudinally-extending conductor groups, and a transversely-extending conductor group connecting said longitudinally-extending conductor groups at a gun end of said sub-assembly;

b. at least one intermediate coil sub-assembly including a pair of substantially-linear longitudinally-extending conductor groups disposed outside of corresponding conductor groups of the inner coil sub-assembly, and a transversely-extending conductor group bending abruptly away from and connecting said substantially-linear longitudinally-extending conductor groups at a gun end of said intermediate coil sub-assembly; and c. an outer coil sub-assembly including a pair of substantially-linear longitudinally-extending conductor groups disposed outside of corresponding conductor groups of the at least one intermediate coil sub-assembly, and a transversely-extending conductor group bending abruptly away from and connecting said substantially-linear longitudinally-extending conductor groups at a gun end of said outer coil sub-assembly;

at least two adjacent ones of said transversely-extending conductor groups at the gun ends of the coil sub-assemblies being spaced apart from each other to produce spatially-separated influences on correction of the deflection field, said at least two transversely-extending conductor groups having predetermined shapes and axial positions for producing said influences.

2. A display tube apparatus as in claim 1 where the transversely-extending conductor groups at the gun end of the at least one intermediate coil sub-assembly extends along a substantially straight path around a neck portion of the display tube.

3. A display tube apparatus as in claim 1 or 2 where the transversely-extending conductor groups at the gun end of the outer coil sub-assembly extends along a substantially straight path around a neck portion of the display tube.

4. A display tube apparatus as in claim 1 or 2 where the transversely-extending conductor group at the gun end of the outer coil sub-assembly has a central portion disposed between first and second adjacent portions, said central portion being located closer to the display screen than said first and second adjacent portions.

5. A display tube apparatus as in claim 1 or 2 where all of the transversely-extending conductor groups at the gun ends of the respective coil sub-assemblies are spaced apart from each other and where said gun ends form windows between adjacent ones of said conductor groups.

6. A display tube apparatus as in claim 1 or 2 where adjacent longitudinally-extending conductor groups of at least two of the coil sub-assemblies extend at an angle to each other over a part of their lengths.

7. A display tube apparatus comprising a display tube including a longitudinal axis, a display screen, an electron gun system for producing at least one electron beam, and electromagnetic deflection means for producing an electron-beam deflection field, said means including a line deflection coil system and a field deflection coil system, one of said deflection coil systems including first and second saddle-type deflection coils disposed at opposite sides of the display tube, each of said saddle-type deflection coils including a transversely-extending conductor group, at an end of said coil remote from the gun, and:

a. an inner coil sub-assembly comprising a pair of longitudinally-extending conductor groups, and a transversely-extending conductor group connecting said longitudinally-extending conductor groups at a gun end of said sub-assembly;

b. a first intermediate coil sub-assembly comprising a pair of substantially-linear longitudinally-extending conductor groups disposed outside of and adjacent to corresponding conductor groups of the inner coil sub-assembly, and a transversely-extending conductor group bending abruptly away from and connecting said substantially-linear longitudinally-extending conductor groups at a gun end of said first intermediate coil sub-assembly, said transversely-extending conductor group being spaced apart from the transversely-extending conductor group at the gun end of the inner coil sub-assembly to produce a spatially-separated influence on correction of the deflection field and having a predetermined shape and axial position for producing said influence; and c. an outer coil sub-assembly comprising a pair of substantially-linear longitudinally-extending conductor groups disposed outside of corresponding conductor groups of the first intermediate coil sub-assembly, and a transversely-extending conductor group bending abruptly away from and connecting said substantially-linear longitudinally-extending conductor groups at a gun end of said outer coil sub-assembly, said transversely-extending conductor group being spaced apart from the transversely-extending conductor group of the first intermediate coil sub-assembly to produce a spatially-separated influence on correction of the deflection field and having a predetermined shape and axial position for producing said influence.

8. A display tube apparatus as in claim 7 where each of said saddle-type deflection coils includes a second intermediate coil sub-assembly comprising a pair of substantially-linear longitudinally-extending conductor groups disposed between corresponding conductor groups of the first intermediate coil sub-assembly and the outer coil sub-assembly, and a transversely-extending conductor group bending abruptly away from and connecting said substantially-linear longitudinally-extending conductor groups at a gun end of said second intermediate coil sub-assembly, said transversely-extending conductor group being spaced apart from the transversely-extending conductor group of the first intermediate coil sub-assembly to produce a spatially-separated influence on correction of the deflection field and having a predetermined shape and axial position for producing said influence.

9. A display tube apparatus as in claim 7 or 8 where the transversely-extending conductor group at the gun end of the first intermediate coil sub-assembly extends along a substantially straight path around a neck portion of the display tube.

10. A display tube apparatus as in claim 7 or 8 where the transversely-extending conductor group at the gun end of the outer coil sub-assembly extends along a substantially straight path around a neck portion of the display tube.

11. A display tube apparatus as in claim 7 or 8 where the transversely-extending conductor group at the gun end of the outer coil sub-assembly has a central portion disposed between first and second adjacent portions, said central portion being located closer to the display screen than said first and second adjacent portions.

12. A display tube apparatus as in claim 7 or 8 where all of the transversely-extending conductor groups at the gun ends of the respective coil sub-assemblies are spaced apart from each other and where said gun ends form windows between adjacent ones of said conductor groups.

13. A display tube apparatus as in claim 7 or 8 where the adjacent longitudinally-extending conductor groups of at least two of the coil sub-assemblies extend at an angle to each other over a part of their lengths.

14. A display tube apparatus as in claim 1, 2, 7 or 8 where the gun ends of at least two adjacent ones of the coil sub-assemblies define a substantially rectangular opening between said gun ends.

* * * * *